US007270589B1

(12) United States Patent
Brown, Jr. et al.

(10) Patent No.: US 7,270,589 B1
(45) Date of Patent: Sep. 18, 2007

(54) RESILIENT LEG DESIGN FOR HOPPING RUNNING AND WALKING MACHINES

(75) Inventors: H. Benjamin Brown, Jr., Pittsburgh, PA (US); Garth J. Zeglin, Pittsburgh, PA (US); Illah R. Nourbakhsh, Pittsburgh, PA (US)

(73) Assignee: Carnegie Mellon University, Pittsburgh, PA (US)

( * ) Notice: Subject to any disclaimer, the term of this patent is extended or adjusted under 35 U.S.C. 154(b) by 0 days.

(21) Appl. No.: 09/569,641

(22) Filed: May 12, 2000

Related U.S. Application Data

(60) Provisional application No. 60/134,366, filed on May 14, 1999.

(51) Int. Cl.
*A63H 7/00* (2006.01)
*A63H 3/00* (2006.01)

(52) U.S. Cl. ..... 446/317; 446/315

(58) Field of Classification Search ..... 487/77, 487/110; 446/330, 335, 361, 365, 308–312, 446/315, 317; 124/23.1, 25
See application file for complete search history.

(56) References Cited

U.S. PATENT DOCUMENTS

| | | | | | |
|---|---|---|---|---|---|
| 480,065 | A | * | 8/1892 | Boyd | 446/193 |
| 1,625,430 | A | * | 4/1927 | Robinson | 446/309 |
| 1,649,072 | A | * | 11/1927 | McAllaster | 446/339 |
| 3,205,615 | A | * | 9/1965 | Baron | 446/311 |
| 4,037,357 | A | | 7/1977 | Monroe et al. | |
| 4,192,280 | A | * | 3/1980 | Rickard | 124/25.6 |
| 4,282,677 | A | | 8/1981 | Abe | |
| 4,300,521 | A | * | 11/1981 | Schmitt | 124/25.6 |
| 4,408,600 | A | | 10/1983 | Davis | |
| 4,492,374 | A | | 1/1985 | Lekhtman et al. | |
| 4,547,913 | A | | 10/1985 | Phillips | |
| 4,645,509 | A | | 2/1987 | Poggi et al. | |
| 4,649,891 | A | * | 3/1987 | Bozek | 124/25 |
| 4,684,111 | A | | 8/1987 | Hagemeister | |
| 4,702,720 | A | | 10/1987 | Konta et al. | |
| 4,763,885 | A | | 8/1988 | Zamitter | |
| 4,802,880 | A | | 2/1989 | Shaw | |
| 4,834,200 | A | | 5/1989 | Kajita | |
| 4,862,980 | A | | 9/1989 | Shkolnik | |

(Continued)

OTHER PUBLICATIONS

"The Bow Leg Hopping Robot" by Brown et al., from Proceedings of the IEEE International Conference on Robotics and Automation, 1998.*

(Continued)

*Primary Examiner*—Sam Rimell
(74) *Attorney, Agent, or Firm*—Kirkpatrick & Lockhart Preston Gates Ellis LLP

(57) ABSTRACT

A leg for use on hopping, running, jumping and walking machines. As incorporated into the bow leg hopper robot, a thrust actuator provides elastic energy to the leg which is automatically released during stance to control hopping height. Lateral motion is controlled by directing the leg angle at touchdown, which determines the angle of takeoff. The leg pivots freely on a hip bearing, and is automatically decoupled from the leg-angle positioner during stance to preclude hip torques that would disturb body attitude. Upright attitude is maintained without active control by allowing the body to hang from the hip joint. The leg may also be incorporated into multilegged running robots, and recreational vehicles.

38 Claims, 10 Drawing Sheets

U.S. PATENT DOCUMENTS

| | | | | |
|---|---|---|---|---|
| 4,928,977 | A | | 5/1990 | Chambers |
| 4,992,072 | A | | 2/1991 | Leigh |
| 5,007,938 | A | | 4/1991 | Prahl |
| 5,011,136 | A | | 4/1991 | Rennex |
| 5,127,484 | A | | 7/1992 | Bares et al. |
| 5,158,493 | A | | 10/1992 | Morgrey |
| 5,205,775 | A | * | 4/1993 | Brodrib ..... 446/317 |
| 5,217,500 | A | | 6/1993 | Phillips |
| 5,258,039 | A | | 11/1993 | Goh et al. |
| 5,279,170 | A | | 1/1994 | Chen |
| 5,326,299 | A | | 7/1994 | Jasinski |
| 5,423,708 | A | | 6/1995 | Allen |
| 5,455,497 | A | | 10/1995 | Hirose et al. |
| 5,464,441 | A | | 11/1995 | Phillips |
| 5,593,456 | A | | 1/1997 | Merlette |
| 5,593,457 | A | | 1/1997 | Phillips |
| 5,618,219 | A | | 4/1997 | Simone et al. |
| 5,653,768 | A | | 8/1997 | Kania |
| 5,725,598 | A | | 3/1998 | Phillips |
| 5,746,773 | A | | 5/1998 | Littig |
| 5,800,568 | A | | 9/1998 | Atkinson et al. |
| 5,827,107 | A | | 10/1998 | Bears et al. |
| 6,558,297 | B1 | * | 5/2003 | Brown et al. ..... 482/77 |

OTHER PUBLICATIONS

ICRA 98 Home Page, located at http://www.laas.fr/icra-98/.*

"Self-Stabilizing Running", Proceedings of the 1997 IEEE International Conference on Robotics and Automation, Albuquerque, New Mexico, Apr. 1997, Robert Ringrose, MIT Leg Lab, MIT Artificial Intelligence Laboratory, pp. 487-493.

"Design of a Robot Leg with Elastic Energy Storage, Comparison to Biology, and Preliminary Eperimental Results", Proceedings of the 1997 IEEE International Conference on Robotics and Automation, Albuquerque, New Mexico, Apr. 1996, Matthew D. Berkemeier and Kamal V. Desai, Dept. of Aerospace and Mechanical Engineering, Boston Unviersity, Boston, MA; pp. 213-218.

"Experiments with an Electrically Actuated Planar Hopping Robot", Intl. Symp. On Exper. Robotics III, 1993, Kyoto, Japan, P. Gregorio, M. Ahmadi and M. Buehler, Centre for Intelligent Machines, McGill University, Department of Mechanical Engineering, Montreal, Quebec, Canada.

* cited by examiner

RESILIENT LEG DESIGN FOR HOPPING RUNNING AND WALKING MACHINES

CROSS-REFERENCE TO RELATED APPLICATIONS

This application claims priority under 35 U.S.C. § 119(e) to provisional U.S. Patent Application Ser. No. 60/134,366 filed May 14, 1999.

FEDERALLY SPONSORED RESEARCH

Not applicable.

BACKGROUND OF THE INVENTION

1. Field of the Invention

The subject invention relates to legged vehicles and toys, and, more particularly, to a resilient leg and its embodiment in a robot for which it provides hopping propulsion.

2. Description of the Invention Background

Human beings and animals have remarkable abilities to walk and run over a wide variety of terrain. In running, as distinct from walking, a machine (or animal) exhibits periods of flight in which contact with the ground is completely lost. Running in general is a dynamic phenomenon where inertial forces are significant, and balance is achieved by active means, not by static equilibrium. Running allows higher speeds than walking, and exploits dynamics to negotiate widely spaced (horizontally or vertically) footholds.

There have been a number of efforts at building running robots. One running robot was a planar one-legged hopper that operated in low effective gravity on an inclined table with thrust provided by a high-force electric solenoid. A succession of machines tested one-leg, two-leg and four-leg designs both in the plane and in three dimensions (3D). Most used a telescoping leg with an internal air spring for compliance, and hydraulic actuators. Some machines have been controlled by the same basic decomposition into three independent linear controllers: forward velocity controlled by foot placement, hopping height controlled by thrust, and pitch controlled by hip torque during stance. This control involved high force and power during stance.

There have been several examples of electrically actuated hoppers. One was constructed with a one-leg electrically actuated planar hopper with a leg constructed from a four bar linkage with a tension spring. Another was built with a one-leg planar hopper with electric motors instead of hydraulics and a metal spring instead of an air spring. Others designed an electrically actuated leg with three revolute joints that used an electric motor coupled with elastic tendons to drive the foot. Others have been designed with an electrically actuated telescoping leg constrained to the vertical. It incorporated a DC motor driving a ball screw in series with a steel spring.

While research on dynamically-stabilized legged locomotion has been completed, previous hopping/running machines have been characterized by the following shortcomings: (i) inefficiency due to losses in the mechanical system and negative work; (ii) the need for large, high-powered actuators for excitation and control of motion; (iii) the requirement for excessive power via off-board power supply; (iv) large body-attitude disturbances and control effort; (v) the inability to perform precise motion control needed for reliable movement over complex terrains; (vi) control complexity; and (vii) vulnerability to damage. In short, previous concepts of running machines have been confined to laboratory environments, and have not been suitable for practical legged locomotion. Thus, there is a need for legged vehicles, which are energy efficient and simple.

There is a further need for a hopper robot that employs a pivoting hip, which minimizes the torque coupling and attitude disturbances during stance.

There is still another need for a hopping robot that is self-righting without the need for computation, actuation, or energy for pitch control.

There is yet another need for a leg that is lightweight and that can be positioned with a low-power actuator such that minimal disturbance is applied to the body.

Another need exists for a leg that has high passive restitution to minimize the energy that needs to be added for each cycle, and to make the impacts relatively repeatable and predictable.

Still another need exists for a hopping, jumping or running robot that stores energy during flight to enable the use of low-powered actuators.

SUMMARY OF THE INVENTION

In accordance with one form of the present invention, there is provided a robot leg comprising a curved spring, pivot bearing, and tension element, and a hopper robot incorporating the leg. The leg is named the "Bow Leg" for its resemblance to an archery bow, and is hereafter referred to as the "leg." The tension element is hereafter referred to as the "bow string."

It is a feature of the present invention to provide a simple, rugged, highly efficient leg for use in hopping, running, and walking machines. In operation a compressive force at the foot causes the leg to compress, efficiently storing, elastic energy in the bending of the spring. The leg can then return this energy by doing work on the environment as the leg extends.

It is a feature of the present invention to provide a bow string to hold the leg in compression. The bow string may be used to store elastic energy in the leg by actuating the free end of the bow string. It may also be used to retain elastic energy in the leg that was stored either by the actuation or by external forces exerted upon the foot.

It is a feature of the present invention to provide a mechanism to retract the bow string and thus store energy in the leg. As applied to a hopper robot, the retract mechanism stores energy to be delivered as thrust. The release of the energy may be automatically triggered upon contact with the ground.

It is a feature of the present invention to provide a one-legged hopper robot that is energy efficient and simple. The present embodiment is constrained to planar operation, but the leg is applicable to three dimensional (3D) operations and multilegged machines.

It is another feature of the present invention to employ a freely pivoting bearing at one end of the leg spring to accommodate the bending motion and ensure that the compressive force always acts through the pivot centerline. As embodied, this bearing serves as the hopper "hip" and this feature minimizes the torque coupling and attitude disturbances during stance. In another embodiment of a hopping machine the hip may be laterally adjustable relative to the center of mass to produce controllable body torques during stance.

It is a feature of the present invention to provide a bending spring with tension constraint used for general energy storage and shock absorption. As a shock absorber the "leg"

attached to one body is compressed by interaction with some other body and stores collision energy as elastic bending.

Another feature of the present invention is to provide a leg that is lightweight and that can be positioned with a low-power actuator such that minimal disturbance is applied to the body.

Yet another feature of the present invention is to provide a hopping robot that is self-righting (the body tends to remain upright due to gravitational forces) without the need for mechanism, force, or energy for pitch control.

Another feature of the present invention is to provide other techniques for body stabilization. One such method is the use of a mechanical stabilizing gyroscope attached to the hopper body to resist changes to body attitude. Another method is the use of aerodynamic control surfaces to actively generate attitude control torques during flight.

The present invention provides a mechanism, which controls the leg angle with respect to the body during flight of the hopping machine.

The present invention further provides a mechanism that limits the torque applied to the hip joint.

Accordingly, the present invention provides solutions to the shortcomings of prior design of legged hopping, walking, jumping and running machines. Those of ordinary skill in the art will readily appreciate, however, that these and other details, features and advantages will become further apparent as the following detailed description of the embodiments of the present invention proceeds.

BRIEF DESCRIPTION OF THE DRAWINGS

In the accompanying Figures, there are shown present embodiments of the invention wherein like reference numerals are employed to designate like parts and wherein.

DETAILED DESCRIPTION OF THE PRESENT EMBODIMENTS

The present invention will be described below in terms of a resilient leg used in a hopping robot. It should be noted, however, that describing the present invention in terms of a resilient leg used in a hopping robot is for illustrative purposes and the advantages of the present invention may be realized using other structures and technologies that have a need for a resilient leg for a vehicle such as three dimensional machines, multi-legged machines, military applications, toys, recreational equipment, etc.

Figure 1:
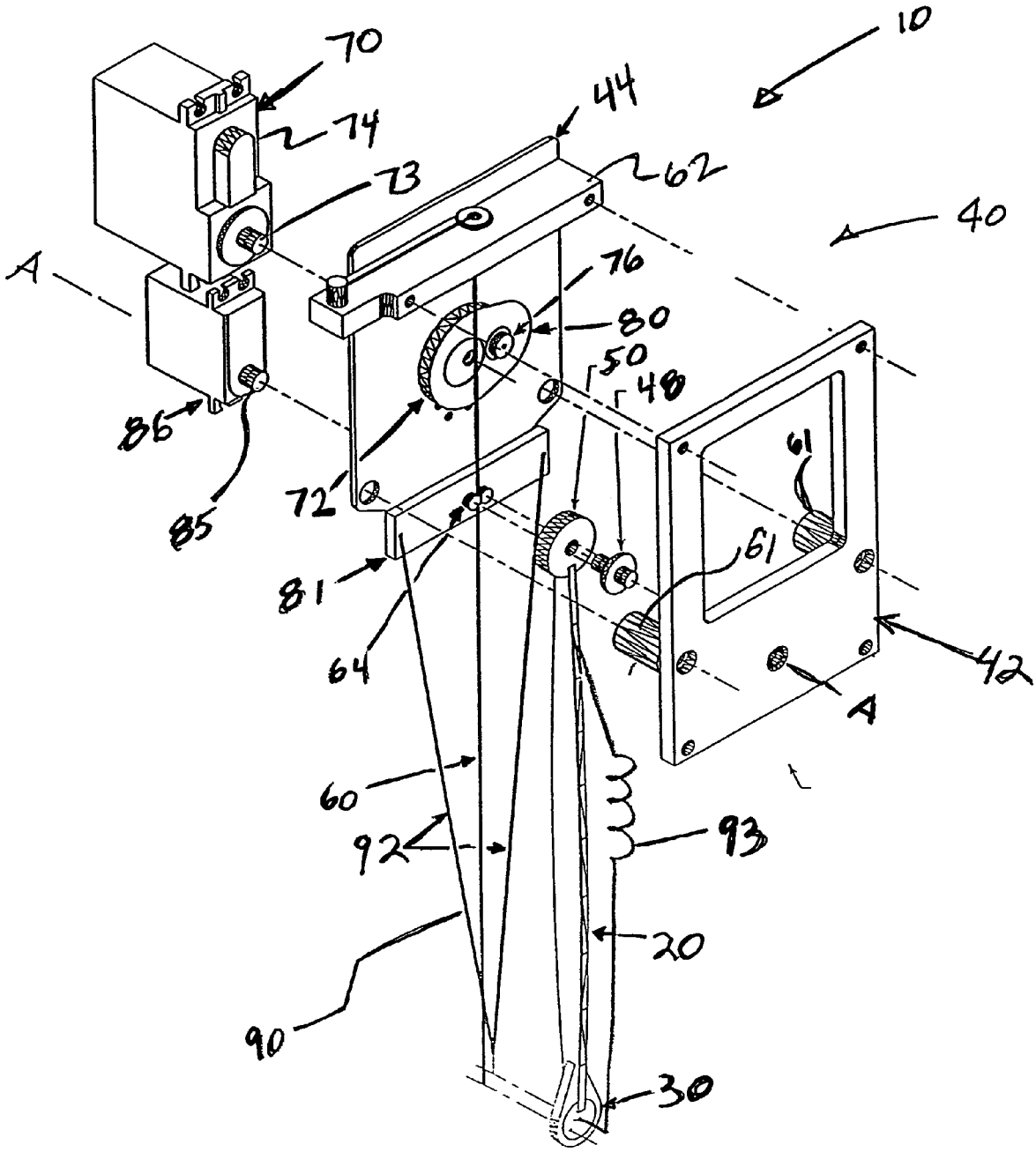
FIG. 1 is an exploded schematic of a planar hopper robot of the present invention.
Figure 2:
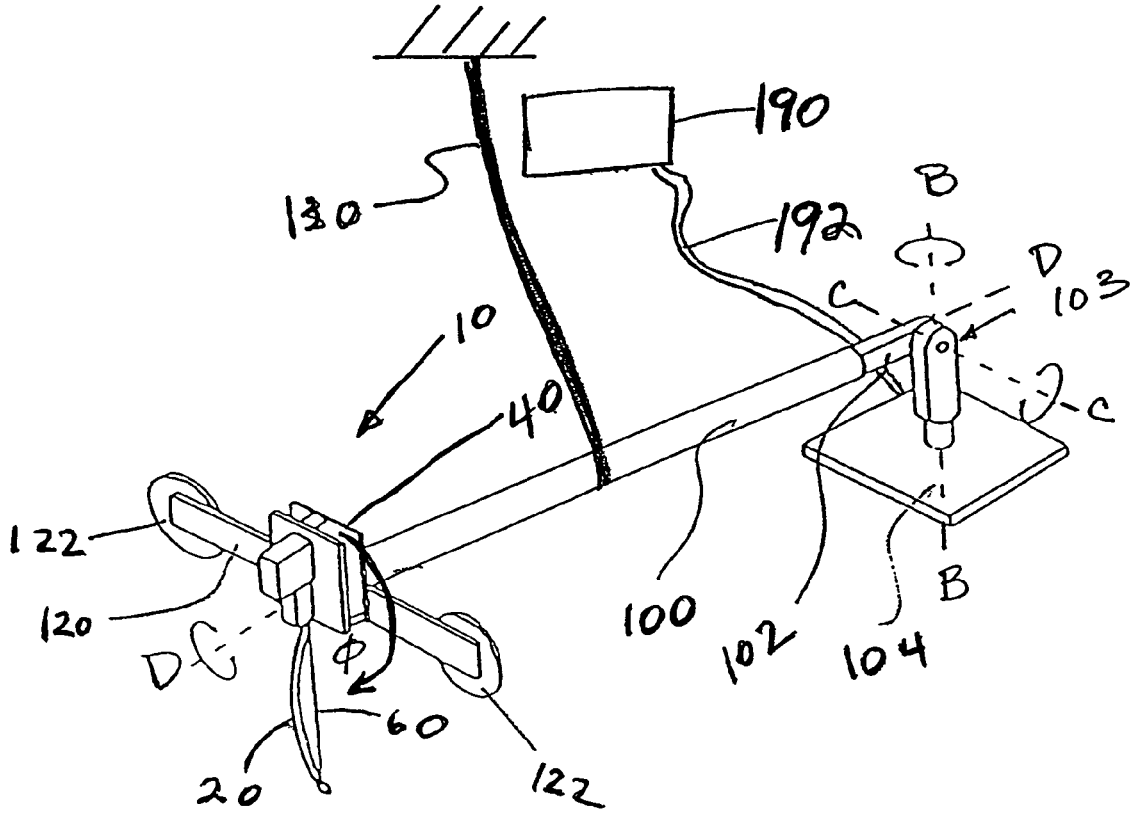
FIG. 2 is a schematic of the planar hopper robot of FIG. 1 and a constraint boom.

FIGS. 1 and 2 show one configuration of a planar hopping robot 10 of the present invention. FIG. 1 is an exploded schematic of the hopper robot 10 of the present invention and FIG. 2 is a schematic of the hopper robot 10 of FIG. 1 attached to a constraint boom 102 and a body portion. As can be seen in FIGS. 1 and 2, the hopper 10 includes a bow leg 20 that comprises a leaf spring of unidirectional fiberglass that becomes curved under the preload tension of the bow string 60. In one embodiment, the bow leg 20 may be 25 cm long. One end of the bow leg 20 is affixed to a foot member 30 that may consist of a substantially circular body made of a lightweight material such as Delrin. The end of the bow leg 20 may be affixed to the foot member 30 by, for example, adhesive bonding. The other end of the bow leg 20 is pivotally affixed to a body structure, generally designated as 40.

The body structure 40 comprises a base plate 42 and a mounting plate 44 that are interconnected together in a spaced-apart relationship. Two spacing members 61 are positioned between the base plate 42 and the mounting plate 44. Base plate 42 and mounting plate 44 may be fabricated from aluminum. However, one of ordinary skill will appreciate that the base plate 42 and mounting plate 44 may be fabricated from other structural materials. As can be seen in FIG. 1, the top end of the bow leg 20 is affixed to a commercially available bearing 50 that is journaled on a hip shaft 48 that is affixed to the base plate 42 and the mounting plate 44 and extends therebetween. Hip shaft 48 serves to define a pivot axis A-A about which the bow leg 20 may pivot relative to the body structure 40.

A bow string 60 is attached to the foot member 30 by, for example, a loop through a horizontal hole in the foot and a knot. The other end of the bow string 60 is affixed to a bow string mooring block 62 that is oriented between the base plate 42 and the mounting plate 44 and is attached thereto. Mooring block 62 may be fabricated from aluminum and be attached to the base plate 42 and the mounting plate 44 by machine screws. The bow string 60 may be affixed to the mooring block 62 by, for example, a turnbuckle to allow adjustment of bow string pre-load. The bow string 60 is also supported through the hip centerline between a pair of commercially available idler pulleys 64 that are journaled on corresponding shafts (not shown) that are affixed to the hip shaft 48. The bow string 60 limits the extension of the leg 20 and allows control of the length of the leg 20 by the thrust mechanism 70 attached to the body 40 above the hip, wherein the hip is located along axis A-A.

The subject invention also comprises a thrust mechanism, generally designated as 70. The thrust mechanism 70 includes a servo disc 72 that may be fabricated from, for example, Delrin, generically known as acetal plastic. The servo disc 72 is mounted to the rotatable shaft 73 of a commercially available hobby servo 74 that is mounted to the mounting plate 44. We have found that the servos commonly used in the model airplane and hobby industry work well for this purpose. A commercially available drive pulley 76 is rotatably affixed to the servo disc 72 as shown. A face spring 80 is affixed to the thrust servo disc 72. Face spring 80 comprises a thin, flexible substantially egg-shaped member, which is pre-loaded by the side force of the bow string 60 that is pulled taut across the face of the face spring 80.

The present hopper 10 may also be provided with a leg positioning lever 81 which is a substantially rectangular bar member made from Delrin, acetal plastic, and is operably affixed to the shaft 85 of a commercially available hobby servo 86. The thrust servo 74 and the leg angle servo 86 are attached to a computer 190 (PC with I/O board) by an umbilical cord 192.

The leg angle positioning mechanism 90 comprises the leg positioning lever 81, a pair of control strings 92, and an elastic element 93 that maintains tension in the control strings. As shown in FIG. 1, one control string 92 is connected to each end of the leg angle positioning lever 81. The control strings converge to a single string that passes through the foot 30 and attaches to the elastic element 93 that terminates on the leg 20. This positioning mechanism limits the torque coupling to the minimum needed for reliable positioning and prevents high torques that might damage the leg angle servo 86. The leg angle servo 86 positions the foot 30 by rotating the leg angle shaft 85 which in turn rotates the leg angle positioning lever 81 and the control strings 92 connected thereto, thus resulting in positioning of the foot 30. It will be appreciated however, that the leg angle positioning mechanism 90 can take many other forms.

In one embodiment, as shown in FIG. 2, the hopper 10 is constrained to move in a circle by a boom assembly 100. The boom assembly includes a boom 102 that may be fabricated from aluminum tubing. One end of the boom 102 is attached to a base 104 by a bearing mounting assembly 103 that permits the boom 102 to pivot about a vertical axis B-B relative to the base 104 and a horizontal axis C-C relative to the base 104. Commercially available sensors (not shown) are affixed to the base 104 to measure the position of the boom relative to the B-B axis and the C-C axis. The other end of the boom 102 is affixed to the base plate 42 of the planar hopper 40 through a third bearing assembly (not shown) to permit the body structure 40 to pivot relative to the boom 102 about axis D-D. A third angle sensor (not shown) at the outboard end of the boom 102 measures body structure 40 pitch angle ($\theta$) to about axis D-D. The umbilical cord 192 may run along the boom 102. Electrical power for the servos 74 and 86 is provided by batteries (not shown) supported on the body structure 40 or the boom 102. A weight bar 120 and two weights 122 provide inertia to stabilize the body structure 40 and allow tuning the location of the body structure 40 center of mass ("COM") relative to the hip. An elastic cord 130 may be connected to and extend between the boom 102 and a ceiling to reduce the effective gravity, lowering the hopping frequency; this provides more time for control execution, facilitates visual observation of behavior, and reduces the power needed to sustain hopping. The lowered gravity is not a fundamental limitation, only an experimental convenience.

During stance, the leg curvature increases, storing energy in elastic bending of the spring. Static equilibrium—neglecting leg inertia and bearing friction—dictates that the contact force with the ground must act through the hip. The free hip pivot allows not only free leg sweep motion but also unhindered rotation associated with the leg compression. In practice, placing the center of mass (COM) slightly below the hip produces a mild restoring effect that keeps the body structure 40 upright passively, even when subjected to significant disturbances. The body 40 then acts as a pendulum, with frequency essentially the same as a comparable statically suspended pendulum. Keeping this pendulum frequency well below the hopping frequency minimizes pitch oscillations excited by the hopping motion. This is similar to the phenomenon reported in *Self-Stabilizing Running*, Robert Ringrose, Proceedings of IEEE International Conference on Robotics and Automation, 1997, Vol. 1, pp. 487-93, which used a large, curved foot to stabilize the pitch of a monopod hopper.

In one exemplary embodiment, the bow leg length is 25 cm and the running circle of the boom 100 is 1.5 m in radius. Effective gravity, a result of the supporting elastic cord and boom geometry, is 0.35 G (3.5 $m/s^2$). Effective machine mass is 4.0 kg, including 0.8 kg in the hopper mechanism itself, 0.2 kg of batteries, and 3.0 kg of ballast and boom weight. The leg 20 itself weighs only 30 g excluding the hip bearing. It is noteworthy that the hopper mechanism comprises only 20% of the total mass; the batteries 5%; and the leg 0.8%. A full 75% of the mass is in the "dead weight" of the weights and boom.

Figure 3:
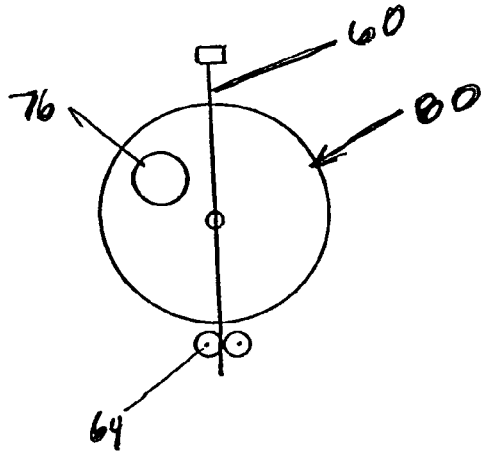
FIG. 3 is a schematic view of a thrust mechanism of the present invention in a relaxed position.
Figure 4:
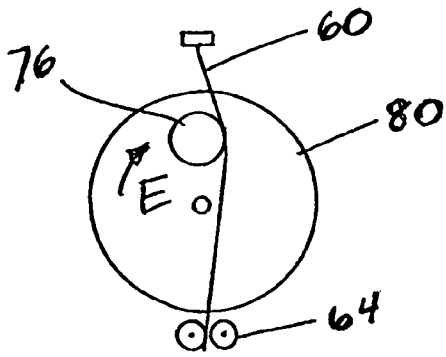
FIG. 4 is schematic view of the thrust mechanism of FIG. 3 in a winding position.
Figure 5:
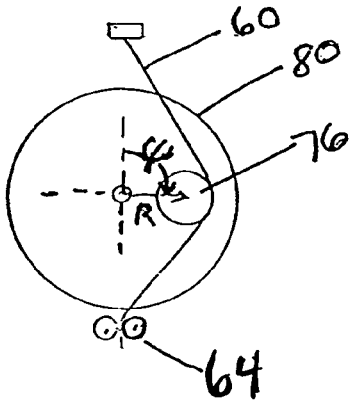
FIG. 5 is a schematic view of the thrust mechanism of FIGS. 3 and 4 in a cocked position.
Figure 6:
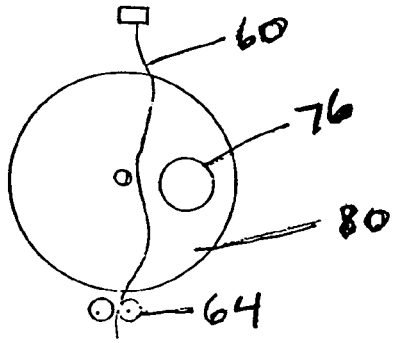
FIG. 6 is a schematic view of the thrust mechanism of FIGS. 3-5 in a released position.

The operation of the thrust mechanism 70 may be appreciated from reference to FIGS. 3-10. The cycle begins in the relaxed state as shown in FIG. 3. The thrust servo 74 then rotates the drive pulley 76 in the direction represented by arrow "E" such that it contacts and displaces or "winds" the bow string 60 as shown in FIG. 4. During the winding stage, the displacement of the bow string 60 compresses the leg 20 (not shown). The energy stored in the cocked position (FIG. 5) is a function of the rotation angle ($\psi$). During the impact of the foot 30 hitting the ground or the release stage as shown in FIG. 6, the bow string 60 goes slack and the pre-loaded face spring 80 nudges the bow string 60 off of the drive pulley 76 and the leg 20 extends to its full length. Thus, during flight, the time when the foot is not in contact with the ground, the thrust mechanism 70 retracts the leg 20 via the bow string 60, adding elastic energy to the leg 20. It then automatically releases the bow string 60 during the time the foot 30 is in contact with the ground ("stance") transferring the elastic energy to system kinetic energy. This injection of energy can compensate for losses in the mechanical system, or produce an increase of system energy. Because energy is stored during relatively long flight periods, a small, efficient, low-power thrust actuator can be used such as a commercially available hobby servo. With some enhancements, this mechanism could also be used to store the machine's kinetic energy in elastic energy in the leg by limiting leg extension at takeoff to less than its touchdown value. This function would be useful to rapidly reduce hopping height or to absorb energy on descending terrain.

Figure 7:
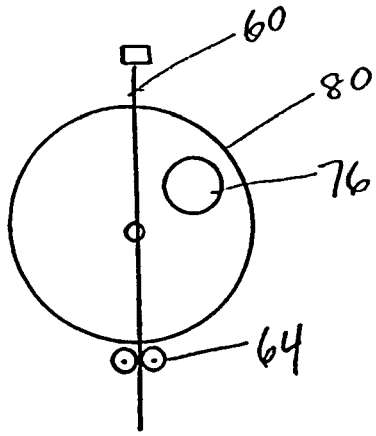
FIG. 7 is a schematic view of the thrust mechanism of FIGS. 3-6 in a second cycle wherein the mechanism is in a second relaxed position.
Figure 8:
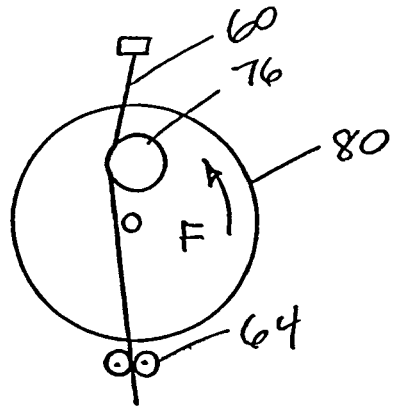
FIG. 8 is a schematic view of the thrust mechanism of FIGS. 3-7 wherein the mechanism is in a second winding position.
Figure 9:
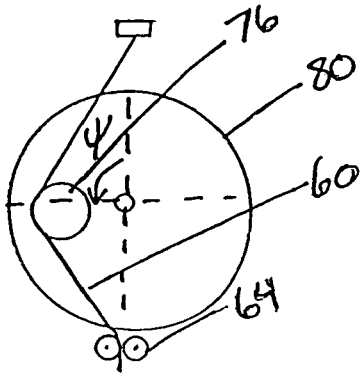
FIG. 9 is a schematic view of the thrust mechanism of FIGS. 3-8 wherein the mechanism is in a second cocked position.
Figure 10:
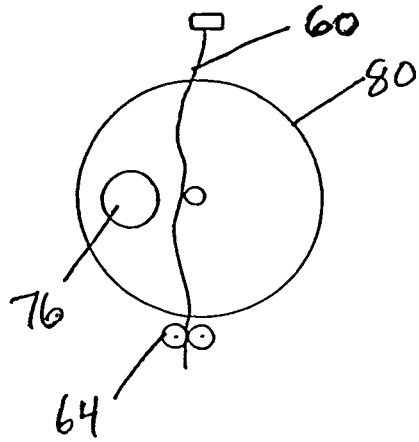
FIG. 10 is a schematic view of the thrust mechanism of FIGS. 3-9 wherein the mechanism is in a second released position.

FIGS. 7 through 10 are schematic views of the thrust mechanism 70 in the cycle succeeding the cycle illustrated in FIGS. 3 through 6. The drive pulley 76 alternately rotates between a clockwise motion and a counterclockwise motion. The cycle when the drive pulley 76 is rotated in the counterclockwise direction begins in the relaxed state as shown in FIG. 7. The thrust servo 74 then rotates the drive pulley 76 in the direction represented by arrow "F", the counterclockwise direction, such that it contacts and displaces or "winds" the bow string 60 as shown in FIG. 8. During the winding stage, the displacement of the bow string 60 acts to compress the leg 20 (not shown). The energy stored in the cocked position (FIG. 9) is a function of the rotation angle (ψ). The greater the rotation angle (up to 90 degrees), the greater the displacement of the bow string 60, the greater the compression of the leg 20 and thus, the greater the energy stored. When the foot 30 impacts the ground, the release stage, as shown in FIG. 10, the bow string 60 goes slack and the pre-loaded face spring 80 nudges the bow string 60 off of the drive pulley 76 and the leg 20 extends fully.

It will be appreciated by those skilled in the art that the geometry depicted in FIGS. 3-10 can be adjusted to effect the desired range of bow string 60 by shortening or lengthening thereof, and the appropriate relationship between tension of the bow string 60 and torque of the thrust servo 74.

The design of the leg 20 for a particular application depends on a number of factors, including the elastic energy storage, the force/deflection characteristics, the length and the maximum deflection. Current implementations of the leg 20 have been fabricated from unidirectional fiberglass composites as used in archery bows, and exhibit specific energies on the order of 100 N-m/N. That is, the elastic energy storage in the leg 20 is sufficient to lift the weight of the leg 20 approximately 100 meters. If the leg 20 has a weight of 1 N, it can store about 100 N-m of energy. If this leg 20 were used on a hopping machine weighing 10 N total, the elastic energy of the leg 20 could lift the whole machine (i.e., hop) about 10 meters. If the machine weighed 100 N, it should be able to hop about 1 meter high, based on the energy storage. For maximum energy storage, the leg 20 must be designed to have nearly constant bending stress along its length; this can be accomplished with a constant material thickness and a width that varies from a maximum at the mid-length to theoretically zero at the tip, with an approximately sinusoidal width profile. Alternately, thickness of the leg 20 may be varied along the length thereof to achieve constant or desirable bending stress, or a combination of width and thickness variations may be employed. Enough width must be provided near the ends to sustain the shear forces in the material. Further improvements in performance can be obtained by using light-weight core laminates; pre-stressing the laminations; tailoring the stiffness and elongation characteristics of individual laminations; and other techniques well known in the composite materials industry.

The force/deflection characteristics of the leg 20 can be affected by the laminating process and the pre-loading of the leg 20. If the leg 20 is laminated in a straight shape (according to the thickness and width constraints described above) or fabricated from a single piece of material, the compressive force is effectively that of a column in compression. The force is nearly constant, increasing by only about 20% from the initial straight shape until the spring is bent to a 180 degree curve. In this design, it behaves nearly as a constant-force spring. If the leg 20 is laminated to an initial curvature, the compressive force will be zero initially, and will increase monotonically to maximum at the maximum deflection based on the allowable bending stress. In this case, the leg 20 will behave more like a conventional compression spring with a fixed spring rate. The force/deflection characteristics can be tailored by means of the initial curvature to get approximately constant force, constant rate, or somewhere in-between.

Figure 14:
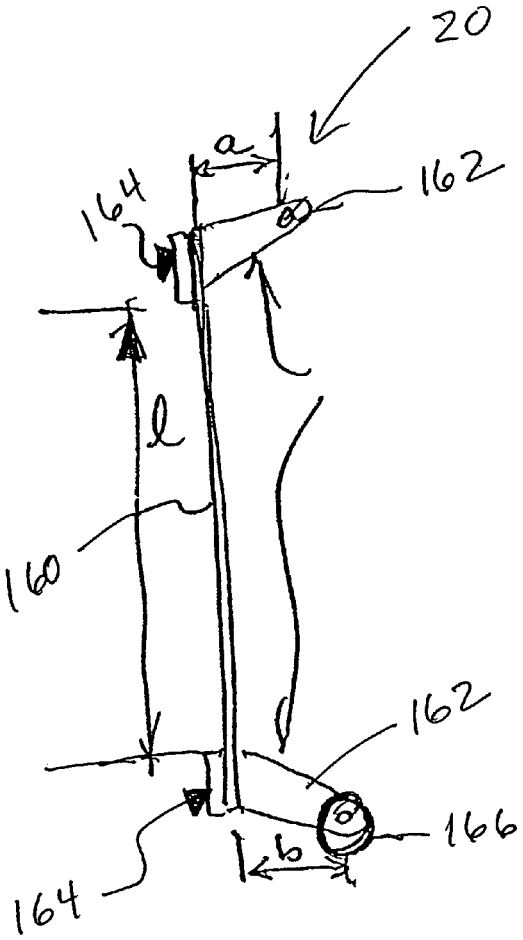
FIG. 14 is a schematic view of another embodiment of the leg of the present invention.
Figure 15:
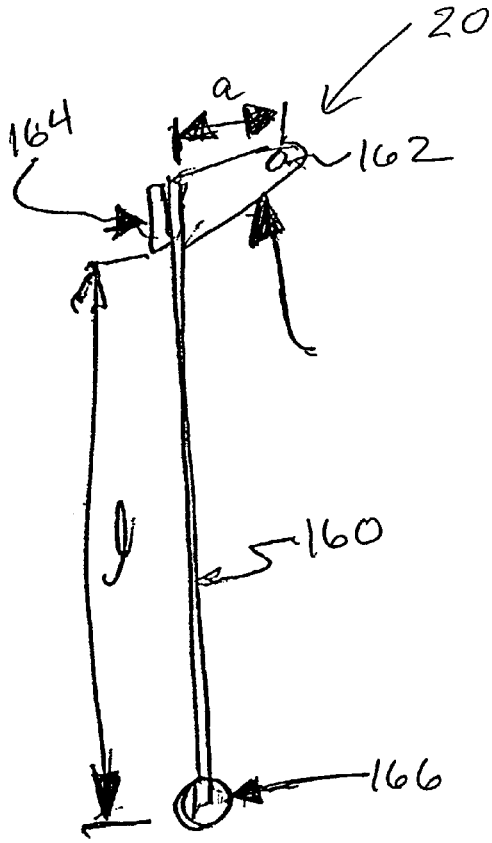
FIG. 15 is a schematic view of yet another embodiment of the leg of the present invention.

Fabrication of the leg may be simplified using an initially flat, monolithic (single-piece) bow leg 160, as shown in FIGS. 14 and 15. A feature of this monolithic material is that it may sustain higher shear stresses than an interlaminar bond of a multi-layer laminate. This permits higher loading and elastic energy storage. In FIG. 14, the flat bow leg 160 is clamped between offset arms 162 and clamp blocks 164 at the top and bottom ends thereof. Machine screws, rivets or other fasteners may be used to clamp blocks to the offset arms 162. The geometry of the arms 162 and bow leg 160 (a, b, l) may be adjusted to obtain different force/deflection characteristics. Generally, if a and b are small, initial stiffness will be high and the bow leg 160 will have nearly constant force. If a and b are large, the behavior of the bow leg 160 will be more like a constant rate spring.

In FIG. 15, a single offset arm 162 is used. The effects of offset length a are generally the same as for FIG. 14. This configuration allows a higher weight and smaller foot 166, and a foot shape more advantageous for ground contact. One additional factor is the pre-load in the tensioning bow string (not shown). This will produce a discontinuity in the force such that the applied compressive force changes from zero to the pre-load force with negligible deflection.

The designs fabricated thus far have utilized a single, unidirectional fiberglass material laminated to the desired thickness and initial curvature or in a flat monolithic structure. Because the bending strain varies from zero at the neutral axis (roughly the middle plane of the laminate) to a maximum at the outer fiber (surface), using different laminate materials in different layers, or prestressing individual laminates can produce improved energy storage, reduced weight or lowered cost. For example, a lightweight core laminate, such as wood, plastic foam or a honeycomb material, may be used for the middle laminations to reduce weight/cost without greatly reducing energy storage. Laminations of different stiffness can be used (stiffer closer to the neutral axis) such that each laminate is stressed to its limit, maximizing energy storage. Another technique is to prestress each layer such that a more beneficial stress distribution is achieved at the fully loaded state; for example, laminating the leg beam in a curved shape, then flexing it past straight and operating it with the curvature reversed, can produce a more nearly constant stress profile in each laminate layer.

While the current embodiments of the invention may employ unidirectional fiberglass as the elastic energy storage material, it will be expected that other material may be used depending on the particular application such as environmental and cost factors, etc. Such material may include, but are not limited to, carbon fiber, reinforced plastics, thermoplastics with or without reinforcement, metals, or other materials.

Figure 11:
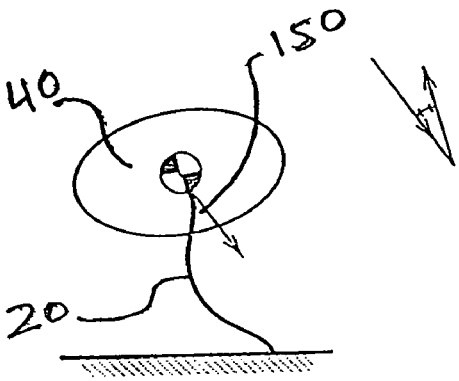
FIG. 11 is a schematic view of the planar hopper robot of the present invention illustrating the impact velocity.
Figure 12:
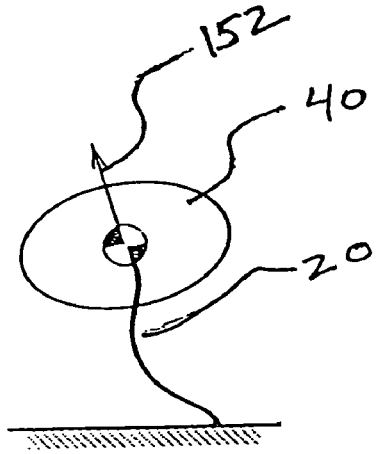
FIG. 12 is a schematic view of the hopper robot of the present invention illustrating the takeoff velocity.

FIG. 11 is a schematic view of the hopper 10 of the present embodiment illustrating the impact velocity and FIG. 12 is a schematic view of the hopper 10 of the present embodiment illustrating the takeoff velocity. The reader will appreciate that it is desirable for a running machine to efficiently handle the large amount of kinetic energy associated with its motion. In the simplest form, a one-legged hopper comprises a mass, body 40, and spring, leg 20, wherein the mobility task is simply a matter of pointing the leg 20 at touchdown along the line perpendicular to the vector average of the impact velocity vector 150 (FIG. 11) and the desired subsequent take-off velocity vector 152 (FIG. 12). The relationship between the impact vector 150 and the take-off vector 152 can be calculated by well known scientific principles. In an ideal system, impact is a perfectly elastic collision with the ground, where the angle of reflection is determined by the angle the leg 20 makes with the ground upon contact therewith. Attitude disturbances disappear because torque on the body 40 is not permitted by the freely pivoting hip.

The basic philosophy for controlling a bow leg hopper (or multi-legged machine) is to set the actuators during flight to achieve the desired response during stance. Based on the output of a high-level planner in response to a desired task specification (such as travel from A to B while avoiding obstacle C), the leg angle and elastic energy increment are set by the leg angle servo and retract actuator. This is done once during each flight phase to prepare the machine for the next bounce. During stance, no control action is taken; the machine behaves as a passive, spring-mass oscillator. This determines the height and direction of the next hop. With the center-of mass of the body 40 slightly below the hip, body attitude is maintained passively without control action, assuming the parameters are properly tuned (body pendulum frequency well below the hopping frequency). In the case where a mechanism is present to adjust the location of the hip relative to the center-of-mass, this is adjusted prior to landing and held during stance to produce a desired impulse on the body angular momentum.

Figure 13:
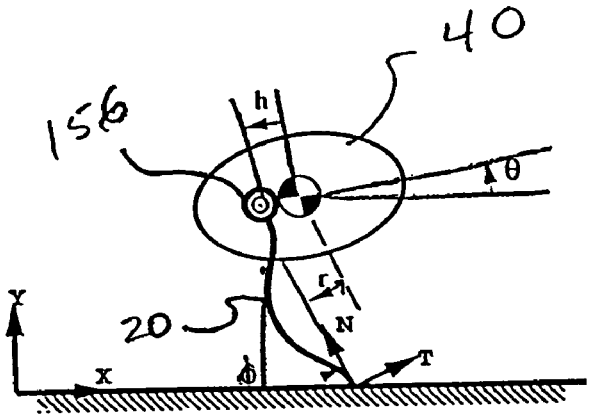
FIG. 13 is a schematic view of another embodiment of the hopper robot of the present invention having a hip pivot point adjustably offset from the neutral hip pivot point.

FIG. 13 is a schematic view of another embodiment of the hopper robot 10 of the present invention having hip pivot point actively positioned during flight to an offset from the neutral hip pivot point. The hip pivot point 156 is offset a distance h from the center of mass of the body structure 40 in order to adjust the ground force moment arm to produce a predictable torque impulse on the body during stance, and thus, control the body rotational velocity. This may be desirable for maintaining body attitude level or producing some desired body rotation, for example. The adjustable hip can augment passive body attitude control achieved by keeping the center of mass below the hip; or it can be used to control body attitude in embodiments wherein the center of mass is at or above the nominal hip position. The hip pivot point 156 can be adjusted during the hopping motion by providing the body structure 40 with a track and actuator (not shown) for the hip bearing 50 (the hip pivot point) to move along during flight and clamp rigidly during stance, when the foot 30 impacts the ground. Theta is body attitude, measured with respect to the world X axis, and is illustrated with a positive value. Phi is the leg angle, measured with respect to the world Y axis, also illustrated positive. Gravity is assumed to point in the Y direction. The center of mass position is defined (x,y), measured from the world origin. The hip offset h and ground force moment arm r illustrated have negative values. The torque impulse on the body is the cross product of the ground force moment arm and the ground impulse. While FIG. 13 illustrates the hip offset in a plane, it will be appreciated that the hip can be offset in two orthogonal direction to extend this concept to 3D.

In the above discussion, the position of the hip is adjusted with respect to the center of mass (COM) of the machine. It will be appreciated that other means may be used to adjust the relative positions of the hip and COM. For example, a weight on the body, such as batteries, motors, electronic components, ballast, etc. could be moved to achieve a relative movement of the COM.

Figure 16:
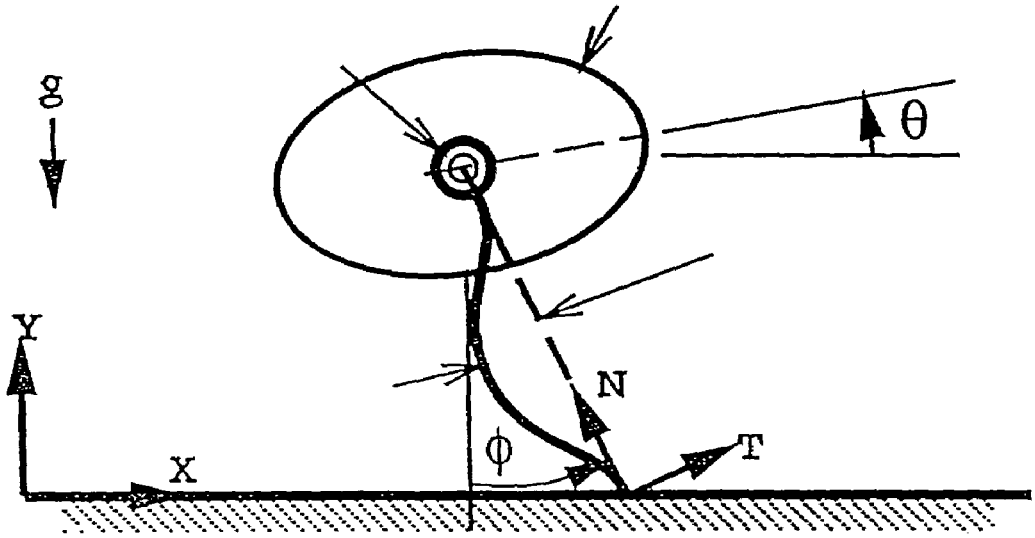
FIG. 16 is a schematic view of the hopper robot of the present invention shown in FIGS. 1 through 10.
Figure 17:
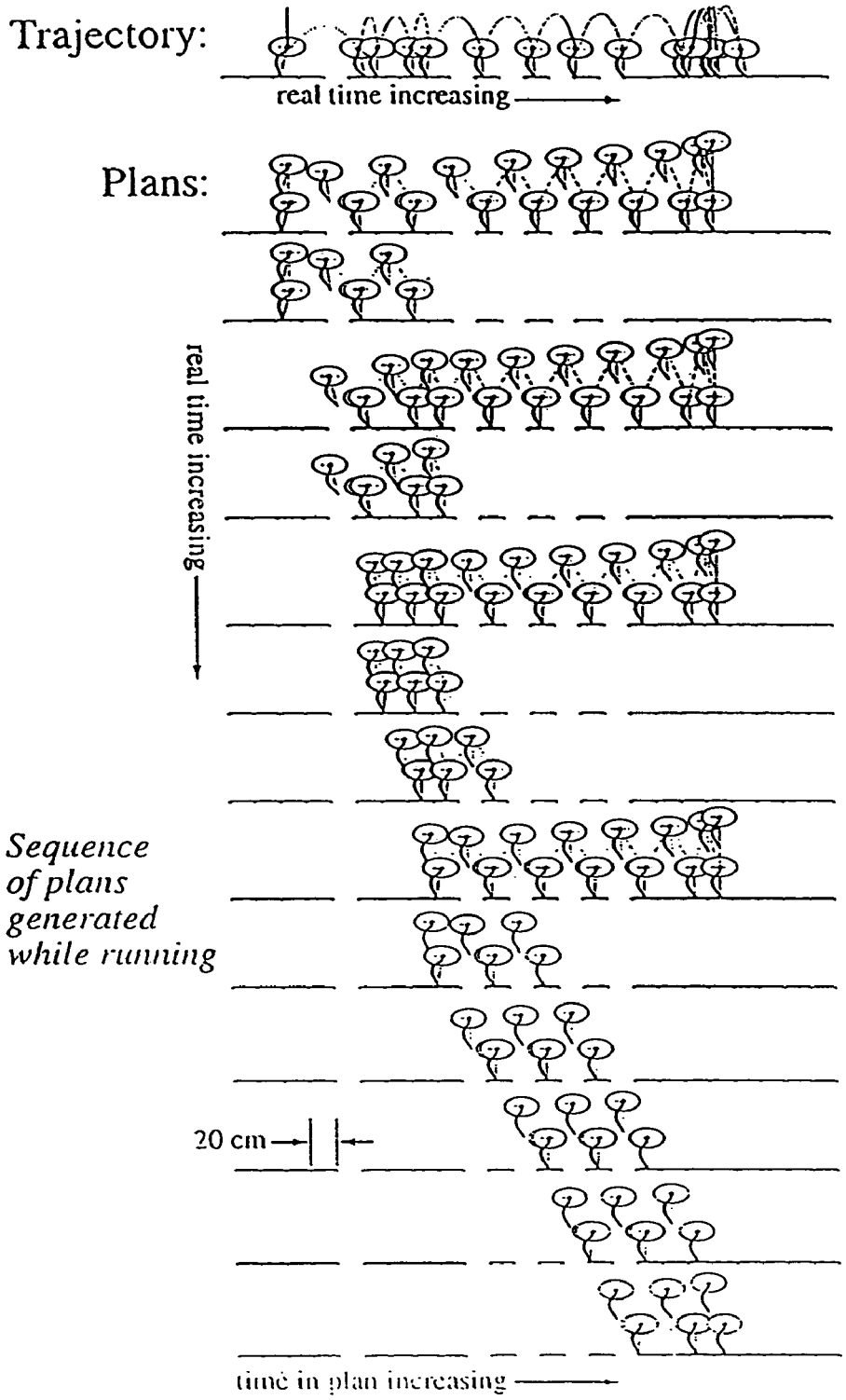
FIG. 17 illustrates experimental run and plans, wherein the top plot illustrates the actual trajectory and therebelow are the succession of plans, wherein real time increases moving down the figure and planning time increases to the right.

FIG. 16 is a schematic view of the hopper robot of the present invention shown in FIGS. 1 through 10. FIG. 17 illustrates experimental run and plans, wherein the top plot illustrates the actual trajectory and therebelow are the succession of plans, wherein real time increases moving down the figure and planning time increases to the right.

The subject invention includes a novel design for a locomoting robot that bounces passively on a flexible, efficient leg. It is controlled by adjusting the leg angle and stored leg energy during flight in preparation for impact. The body pitch rotation is passively stabilized by locating the center of mass slightly beneath the hip. During stance, the actuators are automatically decoupled and the bounce proceeds passively. The trajectory is determined by the impact state and the spring-mass physics of the robot. This design is energy efficient and moves the energy demand from the stance interval to the longer flight interval, reducing the required peak power. This design also imposes novel requirements on a locomotion controller, since the maximum control rate is one update per hopping cycle.

The bow leg mechanical design permits only one control cycle per bounce and this defines the properties of the controller. The controller function takes the following form:

$$(\phi_{n+1}, \Delta E_{n+1}) = f(x_n y_n \dot{x}_n) \quad (1)$$

In this function the variables $(\phi_{n+1}, \Delta E_{n+1})$ are the leg angle and stored leg energy at impact and $(x_n, y_n, \dot{x}_n)$ define the trajectory preceding the impact. This function summarizes the control and comprises the physical model used for feedforward, terrain data, the task being performed, and error feedback. The discrete form can be justified by examining the effect of each actuator and the definition of state.

The leg servomotor determines the angle of the leg prior to impact. During flight, the leg carries no load and can be positioned quickly. This motion only slightly affects body pitch since the leg mass is approximately 1% of the body mass. During stance, the leg positioning motor is physically decoupled from the leg. It is conceivable the leg servo could be repositioned during stance in order to exert horizontal ground forces as the bow string regains tension at liftoff, but we consider this unreliable and ignore this possibility. Thus the leg motion can be entirely described as $\phi_n$, the leg angle in world coordinates at impact n.

The thrust motor determines the energy stored in leg tension prior to impact. During flight, the motor performs positive work on the leg spring. It is conceivable for it to immediately reverse and dissipate some stored energy but the net work during flight is always non-negative. During stance, the thrust motor becomes physically decoupled from the leg as the now-slack string is released. The leg then extends to full length, and all stored energy is released. The thrust action can be entirely described as $\Delta E$, a non-negative potential energy added to the kinetic energy.

The full physical state of the planar embodiment nominally has ten dimensions: three body DOF, two actuator DOF, and the corresponding velocities. We make several assumptions to define a trajectory using only three dimensions. First, pitch and pitch velocity may be neglected since the body is designed to passively stabilize pitch and rotates like a slow pendulum. This axis is decoupled from the other coordinates since body rotations only slightly affect the direction of leg forces and the leg position is independently defined in world coordinates. Second, on the time scale of the hopping cycle the actuators have insignificant dynamics and may be treated simply as outputs.

The hopper may thus be treated as a point particle with four state variables (x, y, $\dot{x}$, $\dot{y}$). However, all constraints are assumed to be time-invariant and so only the geometry of the trajectory matters. Since the free flight physics is known, each trajectory can be described by only three parameters; we use the set $(x_n, y_n, \dot{x}_n)$, which are the position and velocity at the apex of the trajectory.

Note that the leg and thrust values are a function of time during flight ($\phi(t)$, $\Delta E(t)$), but only the final values $(\phi_n, \Delta E_n)$ affect the impact. The abstract control problem is described with discrete functions but the implementation does require control over time. The abstract control values closely correspond to the mechanical freedoms: the stored energy is a monotonic function of the thrust servo angle, and the leg angle $\phi$ is the sum of the body attitude $\theta$ and the leg servo angle.

The low motor power does impose timing constraints. The minimum time required to store leg energy depends on the magnitude of $\Delta E$ and the maximum motor power. In practice, the entire flight time is required to store a large impulse, so energy storage for impact n must typically begin immediately after takeoff n−1; that energy will affect the trajectory following impact n. In contrast, the leg servo can typically position the leg shortly before impact since it is moving an unloaded low mass leg.

The controller uses a model of the hopper physics for planning paths and for feedforward control. The physics function is a discrete map from one trajectory to the next given the control parameters of the intervening impact. It combines the physics of the hopper and geometric information about the terrain.

Although the controller views the physical model as a discrete function, the physics is a continuous time system and could be modeled using differential equations. However, the hopper is designed to have dynamics similar to idealized models, so a discrete closed form model was chosen based on idealized analysis, combined with ad hoc but physically motivated corrections.

The various parameters in the model are determined by a least squares fit to a set of recorded trajectories. Some parameter values and statistics are shown in Table 1. The errors listed are the residual; i.e., the distribution of the differences between the predicted and actual trajectory parameters on the same data set with which the model was fitted.

Parameters Computed from Training Set 98-02-21

| Parameter | Value | Definition |
|---|---|---|
| G | −2.43 m/sec$^2$ | effective gravity |
| $\epsilon$ | 0.82 | restitution |
| $\epsilon^2$ | 0.68 | energy restriction |
| $p^s$ | 0.16 | sweep angle coefficient |
| $p^{L1}$ | 0.45 | $^{\Delta E}$ vs. thrust, linear term |
| $p^{t2}$ | −0.07 | $^{\Delta E}$ vs. thrust, quadratic term |

Error Statistics on Training Set 98-02-21

| Statistic | Value | Definition |
|---|---|---|
| $s_x$ | 8 mm | std. dev. of x error |
| $s_y$ | 7 mm | std. dev. of y error |

-continued

Error Statistics on Training Set 98-02-21

| Statistic | Value | Definition |
|---|---|---|
| $s\dot{x}$ | 17 mm/sec | std. dev. of $\dot{x}$ error |
| N | 442 | samples in training set |

The analytic portion of the model is based on the assumption of a massless leg and instantaneous impact. The leg is attached with a pin joint at the hip and an effective pin joint where the foot makes point contact with the ground. With no leg inertia, the free body equilibrium dictates that the ground force applied to the toe lies along the axis of the leg and is balanced by an opposing hip force. The total force on the body is the sum of gravity and the leg spring force. The spring has restitution $\epsilon$ that defines the ratio of impulse released to impulse absorbed. The hopper bounces like a ball on a paddle perpendicular to the leg axis. With no thrust, the tangential velocity is unchanged and the normal velocity is mirrored with a loss:

$$v_{n1} = -\epsilon v_{n0}$$

$$v_{t1} = v_{t0} \tag{2}$$

This may be modified to include the effect of thrust. The energy stored in the leg is a function of thrust motor angle and is independent of the impact state. Assuming perfect transfer from spring storage into kinetic energy, the impact may be modeled as follows:

$$v_{n1} = \sqrt{\epsilon^2 v_{n0}^2 + (p_{t1}\theta_t + p_{t2}\theta_t^2)}$$

$$v_{t1} = v_{t0} \tag{3}$$

The two terms involving the thrust motor angle $\theta_t$ form a quadratic approximation of the energy stored in the leg. The normal impact velocity $v_n 0$ is always negative and normal takeoff velocity $v_{n1}$ is always positive.

In reality, the stance is not instantaneous and the leg sweeps a small arc while in contact. This angle is a function of stance time and the tangential velocity, but we simply lump the effect into a single parameter and approximate the actual leg sweep as follows:

$$\Delta\phi \cong p_s \cdot -v_t \tag{4}$$

The leg angle at liftoff is the sum of the angle at impact and the sweep angle $(\phi_n + \Delta\phi)$. Since the leg angle is not constant during stance the idealized reflection model is only an approximation. However, if the midpoint of the sweep $(\phi_n + 1/2\Delta\phi)$ is used as the effective leg angle in computing the idealized model, the result is good enough to be a useful predictor of takeoff velocity.

The flight model assumes constant gravity and a constant lateral friction force. The effective gravity produced by the constraint boom and gravity compensation spring varies slightly with altitude, but the effect is negligible. The measurable but low horizontal deceleration is presumably due to bearing friction and tether drag.

An experimental task was defined to travel to a destination while obeying gait constraints. The basic constraints on this task are the location of footholds, contact friction, and obstacles. The gait constraints might include a desired velocity or hopping height, task constraints such as "land exactly on foothold x," or arbitrary constraints such as "alternate between short and long steps."

The role of the planner in the control system is to plan sequences of steps that attain the goal while satisfying the constraints. It is desirable that the planner operates in real time, be able to use terrain data obtained on-line, and produce plans tolerant of terrain and control uncertainty.

The planner performs a best-first search of a graph of possible foot placements to explore sequences of trajectories. At every search step, a set of new foot placements (i.e., search nodes) is selected by sampling the continuum of available leg angles at a given impact.

For each leg angle chosen, the trajectory that results is computed; the impact point at the end of the trajectory defines the new foot placement. The sampling procedure guarantees at least one choice of leg angle is selected for each reachable terrain segment. The branching factor of the best-first search is thus a function of the number of terrain segments reachable from a given liftoff and the sample spacing of the selection procedure.

The path is defined as a sequence of foot placements rather than a sequence of states or leg angles. This observes the terrain constraints, but a consequence is that adding a new foot placement to a path involves adjusting previous leg angles. This is performed by a numerical optimization that adjusts the leg angles to minimize the sum of absolute distances between the predicted foot contacts and the desired foot placements.

The best-first search is guided by the following heuristic function in which x and $\dot{x}$ are trajectory parameters, p is the number of bounces from the start, $k_v$ and $k_1$ are constant gains, and $x_d$ is the goal position:

$$x_{err} = x_d - x \tag{5}$$

$$\dot{x}_d = \begin{cases} \dot{x}_{\max}, & \text{if } k_v x_{err} > \dot{x}_{\max} \\ -\dot{x}_{\max}, & \text{if } k_v x_{err} < \dot{x}_{\max} \\ k_v x_{err}, & \text{otherwise} \end{cases}$$

$$\dot{x}_{err} = \dot{x}_d - \dot{x}$$

$$\text{score} = -|x_{err}| - |\dot{x}_{err}| - k_{1p}$$

Currently, the energy of the hopper is regulated using a feedback loop that varies thrust to maintain a constant total energy. The hopper is designed so that the dissipation is relatively independent of forward speed. The planner estimates the operation of this controller so that initial energy ramp-up or ramp-down will be correctly treated, but otherwise only needs to plan leg angles.

The toe is assumed to contact the ground with Coulomb friction with coefficient μ. To avoid slip the leg force must lie inside the friction cone within the angle $\phi_\mu$=arctan μ of the surface normal. Since the leg force is always along the leg axis, leg angles within the friction cone satisfy the friction constraint.

The plan is consistent with the model of the physics but is not naturally stable. The sources of uncertainty that lead the hopper off the plan include systematic error in the physical model, mechanical backlash in the leg servo, error in the state estimation, and friction and backlash in the constraint boom. After each impact the controller computes an adjustment to the plan for the next two impacts intended to return to the planned trajectory. If the error is too large, the controller abandons the plan and begins creating a new one from the measured state.

The leg angles $\phi_1 \ldots \phi_n$ at n successive impacts may be considered a vector that defines the reachable trajectories. In general, a trajectory is defined by three parameters and three successive impacts may span the trajectory space. However, hopping at constant energy reduces the trajectory space to two dimensions. Thus a deviation from the path can be corrected by adjusting two successive leg angles to reattain the planned trajectory. The correction combines linear feedback and feedforward computed using the physical model.

If the corrected foot placement falls outside a safe region defined around the planned foothold, the controller cannot guarantee the safety of that bounce and a new plan is generated. Planning occurs concurrently with execution; the planning system is an anytime planner and computes usable partial plans immediately. When starting from scratch, the best plan available before impact is used, but is then refined during the remainder of the hopping cycle. Once completed, the plan is used until accumulated error forces a replan.

The controller views the hopper as a system controlled once each bounce by supplying values for ϕ and ΔE. The physical hardware does require real time attention to implement these commands. The underlying control software reads sensors and computes state estimates, controls the leg and thrust servo positions, and schedules the control computations. The prototype hopper uses hobby servos for the leg and thrust motors, so the lowest level of position control is implemented in hardware.

The leg actuator controls the leg angle relative to the body. Since ϕ is specified in world coordinates the actuator command is actually a function of body pitch. The thrust actuator angle is computed using the inverse of the thrust model presented hereinabove.

FIG. 17 illustrates a successful experimental trial in which the hopper hops to a location, crossing five "obstacles." In this experiment the obstacles are simply designated regions on the floor with which contact must be avoided. The top plot shows the measured path of the body together with cartoons illustrating the body attitude and leg angle at the moments of impact. Below the recorded data are a series of plans generated during the traverse. The long plans are complete plans to the goal and the short plans are the adjustments computed to correct errors and return to the long plan. Ideally, the hopper would compute the complete plan once and execute it all the way to the goal. In this example the errors were too large on three steps and the complete plan was recomputed with a new starting state. The plans are illustrated using cartoons at impact, liftoff, and the apex to emphasize that the planner uses a discrete physical model that computes the transitions between these positions in closed form.

It is desirable for the control to complement the mechanism in order to take full advantage of every possible motion. Thus, it is desirable to choose an unbiased solution method which can produce the best motion for a task from the space of possible motions. This is manageable in the case of the bow-leg hopper since the discrete control opportunities limit the space of possibilities to a continuous valued choice at discrete intervals.

However, the space of possible motions is vast and redundant and the search must be guided by sensible heuristics. It is important to note that at the heart of the planner is a linear controller that guides the search by choosing desired velocities with a linear function. By embedding this in a planning framework the linear control becomes a recommendation. This has several advantages: the terrain model is easily included, obstacles can be anticipated by looking forward in time, and arbitrary constraints can be observed to allow for a richer expression of tasks without specially programming new algorithms.

The hopper robot 10 is controlled by configuring the leg angle and stored leg energy during flight, which determine two initial conditions for the passive bounce. The new trajectory is a function of the impact state, the two control outputs, and the spring-mass physics of the hopper robot 10 and leg 20. Unlike previous work, the mechanical design requires only one control cycle per bounce and the controller (not shown) takes a discrete form that computes the desired leg angle and stored energy at touchdown ($\phi$, $\Delta E$) from the apex position and horizontal velocity (x, y, x).

A variety of methods might be employed to compute this control function. So far, we have implemented two methods, a linear controller and a planning approach. The linear control is similar to the Raibert three part control: the touchdown leg angle is analogous to foot placement and controls forward speed, and the leg retraction at impact controls total energy, roughly equivalent to hopping height. Because body attitude is passively controlled as a result of the body mass distribution, the need to exert pitch torques during stance is eliminated. Currently, the controller seeks to maintain constant energy in the system by varying the leg retraction performed before each stance period.

The planning approach uses graph search to explore possible sequences of steps that satisfy the constraints of the terrain. The leg angle is selected to produce the desired takeoff angle, based on a numerical solution of the impact physics. The thrust output is chosen to maintain approximately constant total energy. The plan is executed by a controller that evaluates the result of each bounce and adjusts the following two steps to return to the plan.

This approach requires accurately modeling the physics of the hopper robot 10. However, the simple mechanical design creates dynamics that may be well modeled. So far, we have used a closed form model of stance that combines an idealized, instantaneous, impact model with empirically determined adjustments for leg losses and the finite stance time. The flight model similarly combines a uniform acceleration model with adjustments for various disturbances and departures from ideality. The parameters in the model are determined from data by minimizing the least squares difference between the predicted and actual trajectory parameters over sets of approximately 400 bounces.

The hopper control still has a real time component to read sensors, issue servo commands, and cycle through states representing ascent, descent, and stance. At the lowest level, the hobby servos use position feedback to reach commanded positions encoded as PWM (pulse-width-modulated) signals from the control computer.

We have found that a hopper robot 10 constructed in the above-described manner loses only about 15% of its energy each hop. The machine has hopped as high as 50 cm; 80 cm is theoretically possible based on leg elastic energy capacity, with the present machine mass and reduced gravity. A running speed 1.0 m/s has been observed and higher speeds should be achievable. The inherent, passive pitch stabilization has effectively damped pitch errors of about 0.5 radians; larger angles could be tolerated with increased leg-sweep travel. Energy consumption is surprisingly low: the machine runs for 45 minutes on a single charge (approximately 5 w-hr) of the four sub-C cell nickel cadmium batteries, which comprise only 5% the total machine mass.

Experiments with the machine include hopping in place, running at low velocities across level ground, and crossing obstacles composed of "stepping stones" separated by "holes" in which the hopper robot 10 must not land. An experimental run is presented in FIG. 17 along with a typical, automatically generated plan. Typical foothold width is 20 cm, with 20 cm intervening holes.

In the present embodiment, the precision of the motion is limited by the inaccuracies and uncertainties in the flight and stance models, and the precision of actuator control. In particular, the motion is very sensitive to errors in the leg angle at touchdown: a 0.04 radian error in leg angle (1.0 cm lateral error in foot position) translates to a 17 cm error in lateral position at the next touchdown, based on typical hopping conditions (0.3 m hopping height and 0.2 m/s forward speed).

Thus, from the foregoing discussion, it is apparent that the present invention solves many of the problems encountered by prior running robot designs. For example, the present invention addresses the problem of hip torque. That is, because the leg is allowed to pivot freely at the hip during stance, and the body center of mass (COM) is located at or slightly below the hip, generation of torques on the body by the leg is precluded. This approach leads to the following benefits: (i) effort and energy loss in attitude control are minimized; (ii) leg/hip need not accept/produce large torques; (iii) hip actuators can be small; (iv) the leg can be very light; (v) the model and control are simplified (body treated as point mass); and (vi) vulnerability to damage is minimized because of the leg's lateral compliance. Locating the COM below the hip allows the body to be self righting, so no control effort or energy is needed for pitch control. Also, because the leg can be very lightweight, it can be positioned with a low-power actuator, and its motion causes minimal disturbance on the body. The leg also has high passive restitution, minimizing the energy that needs to be added each cycle, and making the impacts relatively repeatable and predictable. These factors simplify the model of the machine dynamics and flight and stance phases, leading to simpler, potentially more precise control. The present invention also differs from prior designs in the manner in which thrust is applied to the device. That is, by storing energy during flight the power demand is distributed across flight, so low-powered, electric actuators are suitable.

Those of ordinary skill in the art will further appreciate that the hopper of the present embodiment is adaptable for crossing rugged, natural and manmade terrains. The efficiency and low power requirements of the present invention are well suited for use by self-contained, electrically powered designs. Further, the high energy storage capacity of the leg permits vertical and horizontal hopping distances on the order of meters, allowing mobility on very rugged terrain. In addition, the natural control of body attitude greatly simplifies modeling and control of the machine. Also, it is expected that, because losses and control effort are small, that dynamic behavior will be quite repeatable and predictable (compared to previous systems with lower efficiency). While the present invention has been described herein as a single leg machine, it will be appreciated that the present invention leg is equally applicable to multi-leg designs. The subject invention is suitable for operation on real terrains, including small footholds spaced irregularly and separated by large horizontal and vertical distances.

Those of ordinary skill in the art will additionally appreciate that the bow leg of the present invention is adaptable for application in three dimensional (3D) hopping, running, and jumping machines with one or more legs. Applications for these machines include but are not limited to the following: robots, vehicles, toys, planetary exploration, and recreational equipment.

While walking machines are bounded by their kinematic limits, running, walking, jumping and hopping machines are bounded only by dynamic limits. A high strength composite spring can have a specific energy of 100 meters or more; that is, it can store enough energy to lift its own weight more than 100 meters. Thus, a machine having 5% of its mass in the leg could theoretically hop 5 meters or more. Of course, this performance is dependent upon allowable accelerations and ground forces, and the ability to control body attitude. Lateral hopping distance is twice the height capability, assuming an ideal trajectory. In reality, the hopper may be able to store substantial additional energy due to its horizontal motion. This energy could be employed for hill climbing or long jumping, or converted to vertical motion in a "pole vaulting" mode.

A critical issue in controlling a three dimensional (3D) hopping machine is maintaining body attitude. This problem is minimized with the free hip pivot of the bow leg, but additional fine control of body pitch, roll, and yaw may be required. One mechanism to control body attitude is a mechanical stabilizing gyroscope attached to the hopper body to resist changes in body attitude. Another such mechanism is the use of aerodynamic control surfaces attached to the hopper body.

Figure 18:
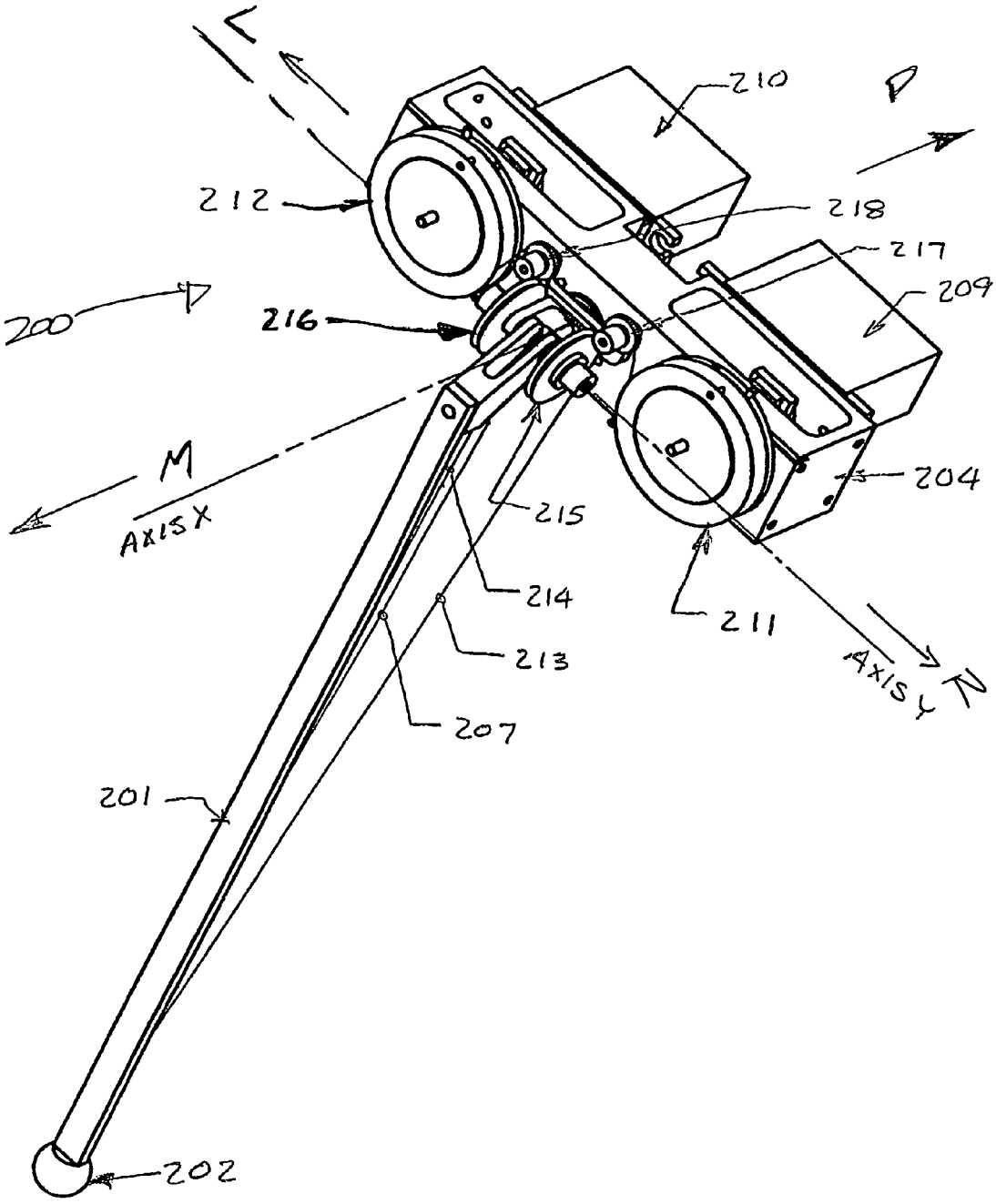
FIG. 18 is another embodiment of a hopping machine employing the present invention that operates in 3 dimensions.
Figure 19:
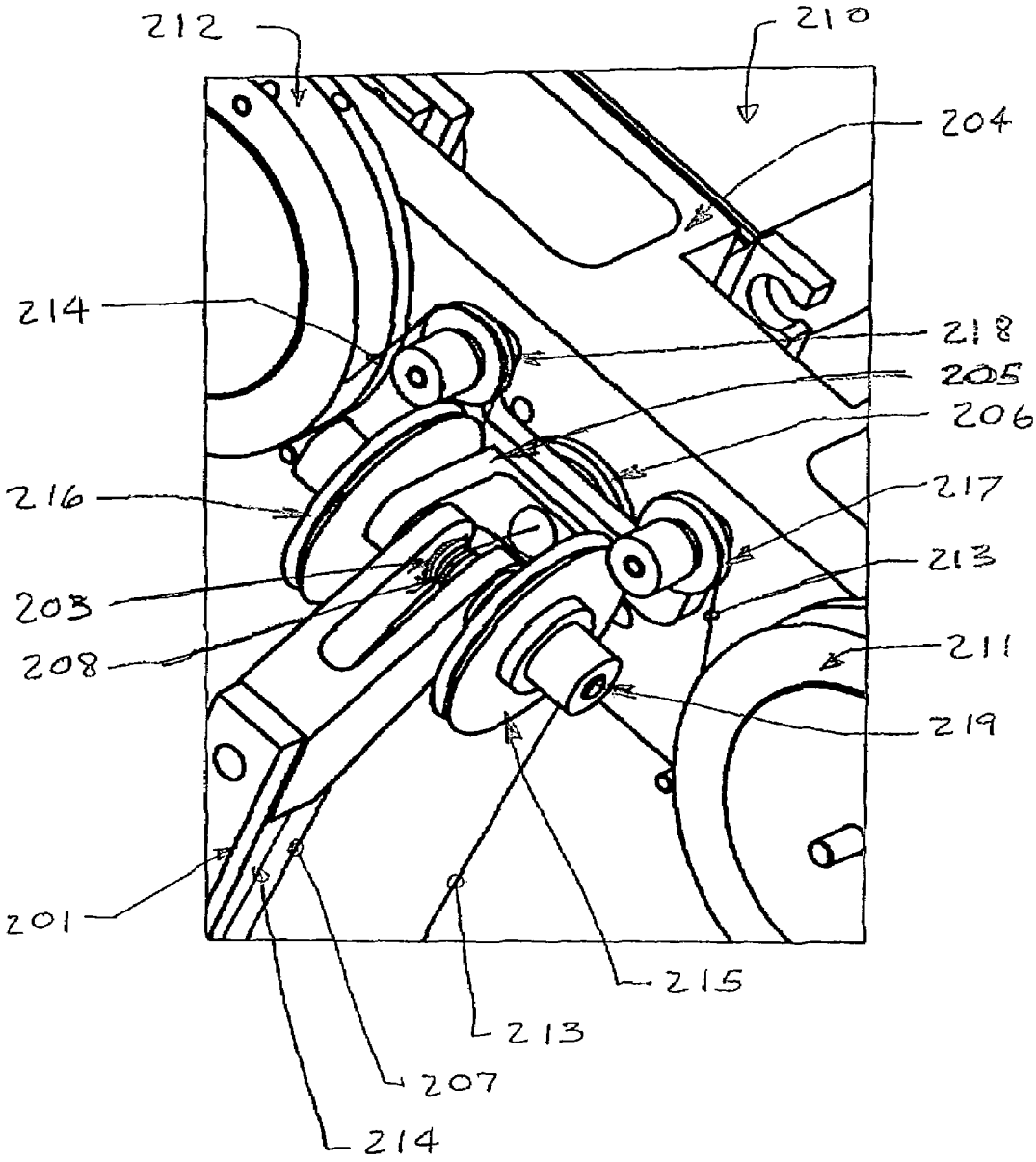
FIG. 19 is a detailed view of the hopping machine shown in FIG. 18.

FIGS. 18 and 19 illustrate another embodiment of a hopping machine 200 employing the present invention. This embodiment illustrates a machine 200 that is not constrained by a boom or tether, but is free to move in 3-dimensional (3D) space. This machine 200 comprises a leg 201, a foot 202, a freely pivoting hip bearing 203, a body member 204, a hip yoke 205, a yoke bearing 206, a bow string 207, a hip pulley 208, a pair of leg control actuators 209 and 210, drive pulleys 211 and 212, a pair of control strings 213 and 214, primary control string pulleys 215 and 216, and intermediate control string pulleys 217 and 218.

The bow leg 201 with foot 202 contacts the ground and the freely pivoting hip bearing 203 allows the leg 201 to rotate about the y-axis. The hip yoke 205 and yoke bearing 206 connect the bow leg 201 to the body 204 and allow the leg 201 to rotate about x-axis. The bow string 207 is attach to the foot 202 and is routed around the hip pulley 208 and terminates at a thrust mechanism (not shown) that may retract the bow string 207 to compress the leg 201 and add energy to the system. The pair of leg control actuators 209 and 210 with drive pulleys 211 and 212 are mounted on the body 204. The primary control string pulleys 215 and 216 are mounted concentrically with the hip pulley 208 on the hip shaft 219 on the yoke 205. The intermediate control string pulleys 217 and 218 are mounted on the yoke 205. Each control string 213 or 214 originates at the foot 202, wraps one revolution around one of the primary idler pulleys 215 or 216, wraps partially around one of the intermediate idler pulleys 217 or 218, and terminates on one of the drive pulleys 211 or 212.

The hip joint and leg control mechanism enable the leg to be swung along the y-axis as well as along the x-axis, allowing the machine 200 to move in any direction on the ground surface. While the machine 200 is in flight and the foot 202 is not in contact with the ground, the bow string 207 provides a tension force that compresses the leg 201 to a degree depending on the state of the thrust mechanism (not shown). It will be appreciated that the tension in the bow string 207 provides a torque on the leg 201 about the hip shaft 219 equal to the string tension force times the radius (r) of the hip pulley 208. This torque tends to swing the leg 201 in the M direction. This torque is balanced by the combined tensions of the left and right control strings 213 and 214 passing around the primary control string pulleys 215 and 216 of radius R. Based on a standard static torque balance, the ratio of the combined control string tensions to the bow string 207 tension is equal to the ratio of the radii of the pulleys (r/R). The maximum torque available to swing the leg 201 in the M direction occurs when the control string actuators 209 and 210 move their respective drive pulleys 211 and 212 to extend the two control strings 213 and 214, allowing them to go slack. Similarly, if both control strings 213 and 214 are retracted, control string torque will exceed the bow string torque and the leg 201 will swing in the P direction. The radius of the hip pulley and the tension in the bow string 207 determine the torque available to swing the leg in the M direction. The control string actuators and primary control string pulleys would normally be designed to produce an equivalent net torque for swinging the leg in the P direction. A preloaded torque mechanism (not shown) built into the drive pulleys 211 and 212, limits the control string tension to the nominal value. In order to minimize the disturbance torques on the body during stance (i.e., when the foot is in contact with the ground), these torques should be designed to the minimum values needed for effective control of the leg 201 in flight.

The swing motion along the y-axis of the leg 201 is affected by moving the two control actuators 209 and 210 in opposite directions (e.g., if the left control string 214 is retracted and the right control string 213 is extended, the leg 201 will move in the L direction). The location of the intermediate control string pulley 217 or 218 affects the relationship between the control string tension and lateral torque applied to the leg 201 (e.g., if the left control string 214 is retracted and the right control string 213 is extended such that the right control string 213 becomes slack and the tension in the left control string 214 is twice the nominal value). The lateral swing torque will be equal to the left control string tension times the moment arm of the intermediate control string pulley 218 (*a*) about the yoke bearing 203. In the design of the machine, this moment arm (a) would be selected to provide the desired lateral sensitivity of the control and the range of angular travel.

Those of ordinary skill in the art will, of course, appreciate that various changes in the details, materials and arrangement of parts which have been herein described and illustrated in order to explain the nature of the invention may be made by the skilled artisan within the principle and scope of the invention as expressed in the appended claim.

What is claimed is:

1. A leg, comprising:

a leaf spring, wherein said leaf spring has a uniform thickness and a width that varies sinusoidally such that curvature and bending stresses are practically constant along the length of said leaf spring, structured to store and release energy for locomotion, said leaf spring having a first end and a second end and being connectable to a body member at said first end with a freely pivoting bearing defining a hip portion having a first axis of rotation;

a tension element extending from the second end of said leaf spring and being connectable to said body member; and, means for controlling extension and compression of the leaf spring.

2. The leg of claim 1, wherein said leaf spring is curved.

3. The leg of claim 1, wherein said leaf spring is flat.

4. The leg of claim 1, wherein said leaf spring is made of a flat monolithic material.

5. The leg of claim 1 wherein said leaf spring is made of a prestressed laminate material.

6. A locomotion machine, comprising:

a body member;

a leaf spring having a first end and a second end, said leaf spring connected to said body member at said first end with a freely pivoting bearing defining a hip portion having a first axis of rotation; and, a tension element connected to said second end of said leaf spring and extending therefrom to said body member; and, means for controlling extension and compression of the leaf spring.

7. The locomotion machine of claim 4, wherein said tension element is a bow string.

8. The locomotion machine of claim 6, further comprising a thrust mechanism connected to said body member and selectively engaging said tension element.

9. The locomotion machine of claim 6, further comprising a control lever connected to said body member for controlling the angular position of said leaf spring about the first axis of rotation.

10. The locomotion machine of claim 6, wherein said leaf spring has a curved shape.

11. The locomotion machine of claim 6, wherein said machine is a running and walking machine.

12. The locomotion machine of claim 6, wherein said machine is one of the group consisting essentially of a robot, a toy and a vehicle.

13. The locomotion machine of claim 9, wherein said body member has a center of mass and said hip portion translates along an axis defined by said body member for providing a lateral offset between the hip portion and the center of mass of said body member for controlling torque on said body member.

14. The locomotion machine of claim 6, wherein said body member has a center of mass and said hip portion and said center of mass are movable relative to each other along two orthogonal directions.

15. The locomotion machine of claim 9 further comprising a controller for planning the trajectory of said locomotion machine.

16. The locomotion machine of claim 8 wherein said leaf spring is structured to store and release energy for locomotion and said thrust mechanism has a feedback loop for varying thrust to maintain a desired total energy in said leaf spring.

17. The locomotion machine of claim 6 wherein said freely pivoting bearing is pivotally connected to said body member with a second bearing to define a second axis of rotation about such that said leaf spring is movable relative to the first and the second axes.

18. The locomotion machine of claim 17 further comprising means for controlling body attitude.

19. The locomotion machine of claim 18 wherein said attitude controlling means is a stabilizing gyroscope for controlling body pitch, roll and yaw.

20. The locomotion machine of claim 18 wherein said means for controlling body attitude comprise aerodynamically contoured control surfaces attached to said body member.

21. The locomotion machine of claim 9, wherein said hip portion is connected to said body member above the center of mass of the body member.

22. A locomotion machine, comprising:

a body member;

a leaf spring having a first end and a second end, said leaf spring connected to said body member at said first end with a freely pivoting bearing defining a hip portion;

a control lever connected to said body member; and, a plurality of tension elements, each of said plurality of tension elements connected to and extending between said hip portion of said body member and said leaf spring second end such that said leg has two degrees of freedom movement.

23. The locomotion machine of claim 22, further comprising a tension spring connected to said leaf spring, said tension spring maintains tension within said tension elements during the compression of said leaf spring.

24. A locomotion machine, comprising:

a body member having a hip portion;

a leaf spring having a first end and a second end, said first end of said leaf spring connected to said body member at said hip portion with a freely pivoting bearing;

a control lever connected to said body member;

a foot member fixedly connected to said leaf spring;

a plurality of pulleys connected to said body member at said hip portion; and three tension elements each having a first end and a second end, said second end of each of said three tension elements being connected to said foot member, said first end of one of said tension elements being slideably connected to one of said plurality of pulleys, and the other two first ends of said tension elements being connected to said control lever.

25. The locomotion machine of claim 24, wherein each of said three tension elements are strings.

26. A leg, comprising:

a leaf spring structured to store and release energy for locomotion, said leaf spring having a first end and a second end and being connectable to a body member at said first end with a freely pivoting bearing defining a hip portion having a first axis of rotation, wherein a lever is connected to said hip portion, and wherein said leaf spring is flat; and, a tension element extending from the second end of said leaf spring and being connectable to said body member; and, means for controlling extension and compression of the leaf spring.

27. A locomotion machine, comprising:

a body structure;

a leg member pivotally connected to said body structure;

an elastic element connected to said body structure;

a pair of strings each connected at one end thereof to said elastic element and each connected at the other end to said body structure; and a bow string connected to said leg member at one end thereof and connected to said body structure at the other end of said bow string.

28. The machine of claim 27, wherein said body structure includes a base plate and a mounting plate interconnected in a spaced-apart relationship.

29. The machine of claim 28, wherein said body structure further includes a shaft and a plurality of spacing members positioned between said base plate and mounting plate, wherein said leg member pivots about said shaft.

30. The machine of claim 27, further comprising a foot member attached to the leg member.

31. The machine of claim 30, wherein said bow string is attached to the foot member.

32. The machine of claim 29, wherein said body structure includes a mooring block and said bow string is attached to the mooring block.

33. The machine of claim 28, further comprising a thrust mechanism connected to said body structure.

34. The machine of claim 33, wherein said thrust mechanism includes a servo disc and a face spring, said servo disc is rotatably mounted to a hobby servo, said hobby servo is mounted to said mounting plate.

35. The machine of claim 34, further comprising:

a drive pulley rotatably connected to said servo disc; and a face spring connected to said servo disc.

36. The locomotion machine of claim 27 wherein said leg member is pivotally connected to said body structure along two axes.

37. A machine, comprising:

a body structure having a leg angle positioning mechanism;

a leg member pivotally connected to said body structure and having an axis;

a bow string connected at one end to said leg member and at the other end to said body structure;

wherein said leg angle positioning mechanism comprises a lever connected to said body structure;

a pair of control strings, each control string being connected to said lever and to said leg member; and an elastic member connected to said leg member at one end and connected at the other end thereof to said pair of control strings.

38. The machine of claim 37, wherein said elastic member is a spring that is substantially aligned with the axis of said leg member when the leg member is in an unloaded position.

* * * * *

UNITED STATES PATENT AND TRADEMARK OFFICE

CERTIFICATE OF CORRECTION

PATENT NO. : 7,270,589 B1
APPLICATION NO. : 09/569641
DATED : September 18, 2007
INVENTOR(S) : H. Benjamin Brown, Jr., Garth J. Zeglin and Illah R. Nourbakhsh It is certified that error appears in the above-identified patent and that said Letters Patent is hereby corrected as shown below:

Col. 19, Line 12, delete "Claim 4" and insert --claim 6--.

Signed and Sealed this

Tenth Day of February, 2009

JOHN DOLL
*Acting Director of the United States Patent and Trademark Office*